United States Patent [19]

McKee

[11] 4,422,835

[45] Dec. 27, 1983

[54] FLUID OPERATED DIAPHRAGM PUMP WITH FLUID TIMING CONTROL AND CONTROL CIRCUIT MANIFOLD MOUNTED ON PUMP BODY

[76] Inventor: James E. McKee, Suite 580, States General Life Building, 708 Jackson, Dallas, Tex. 75202

[21] Appl. No.: 194,126

[22] Filed: Oct. 6, 1980

Related U.S. Application Data

[63] Continuation-in-part of Ser. No. 16,185, Feb. 28, 1979, abandoned.

[51] Int. Cl.[3] ..... F04B 43/06

[52] U.S. Cl. ..... 417/401; 91/308

[58] Field of Search ..... 417/395, 398, 399, 401; 91/304, 308, 318; 92/13.2, 13.6

[56] References Cited

U.S. PATENT DOCUMENTS

| | | | |
|---|---|---|---|
| 2,675,758 | 4/1954 | Hughes . | |
| 2,708,411 | 5/1955 | Richardson | 91/318 X |
| 2,732,069 | 1/1956 | Henderson . | |
| 2,773,486 | 12/1956 | Albers | 91/318 X |
| 2,955,539 | 10/1960 | Gardner . | |
| 3,128,782 | 4/1964 | Limpert et al. . | |
| 3,156,320 | 11/1964 | Bystricky et al. . | |
| 3,232,524 | 2/1966 | Rice et al. . | |
| 3,233,523 | 2/1966 | Passaggio . | |
| 3,292,498 | 12/1966 | Zimmerman | 91/308 |
| 3,299,826 | 1/1967 | Williams | 417/395 |
| 3,467,021 | 9/1969 | Green, Jr. . | |
| 3,955,557 | 11/1976 | Takagi . | |
| 4,096,875 | 6/1978 | Jones et al. | 91/308 |
| 4,187,764 | 2/1980 | Cho . | |

FOREIGN PATENT DOCUMENTS

| | | | |
|---|---|---|---|
| 1201348 | 8/1970 | United Kingdom . | |
| 549593 | 4/1977 | U.S.S.R. | 417/395 |

*Primary Examiner*—Leonard E. Smith

*Attorney, Agent, or Firm*—Hubbard, Thurman, Turner & Tucker

[57] ABSTRACT

A pneumatically actuated diaphragm type metering pump is controlled by a pneumatic control circuit including a pilot actuated two position valve for pressurizing and venting the pump power piston chamber and which is controlled by a second pilot actuated two position valve. Timing chambers and a flow control valve in the control circuit operate to vary the frequency of the pumping cycle. The control circuit is included in a manifold assembly made up of a series of circular plate members assembled in staked relationship and including all of the fluid passages of the control circuit as well as the pneumatic timing chambers. The manifold assembly is mounted directly on an end wall of the pump body which provides for a single control fluid inlet passage and a single discharge passage for venting control and power piston fluid from the pump. The pump stroke may be varied by an adjustable abutment engageable with the pump power piston and including a threaded shank portion projecting through an end wall of the pump body into a bore in the manifold assembly whereby the abutment may be adjusted from the exterior of the pump.

19 Claims, 5 Drawing Figures

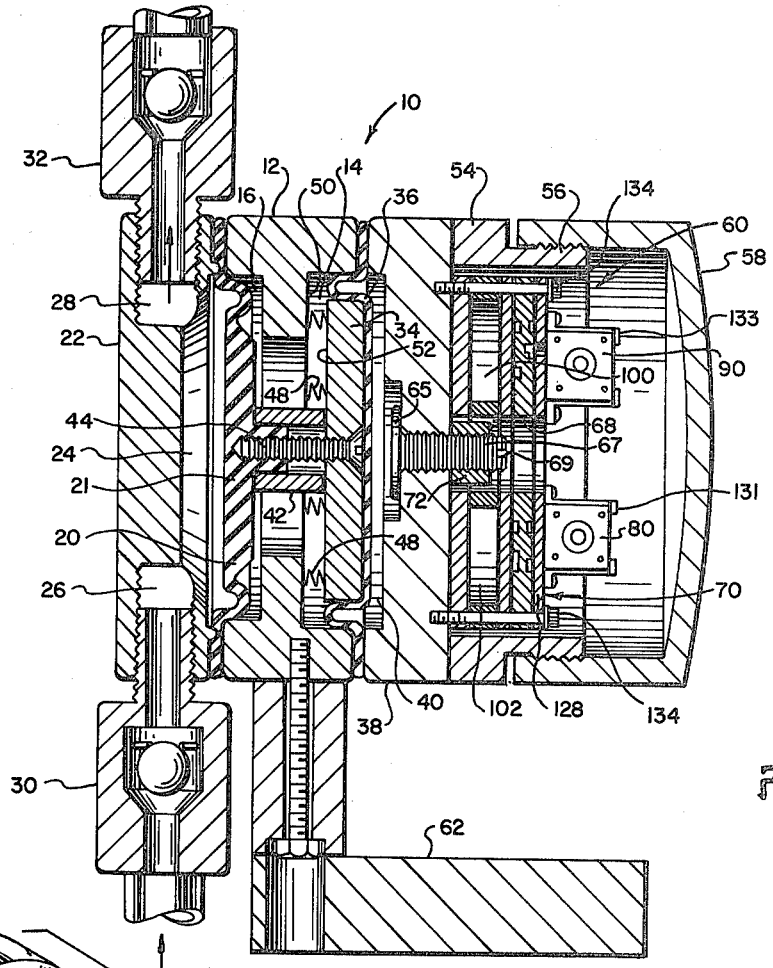
FIG. 1
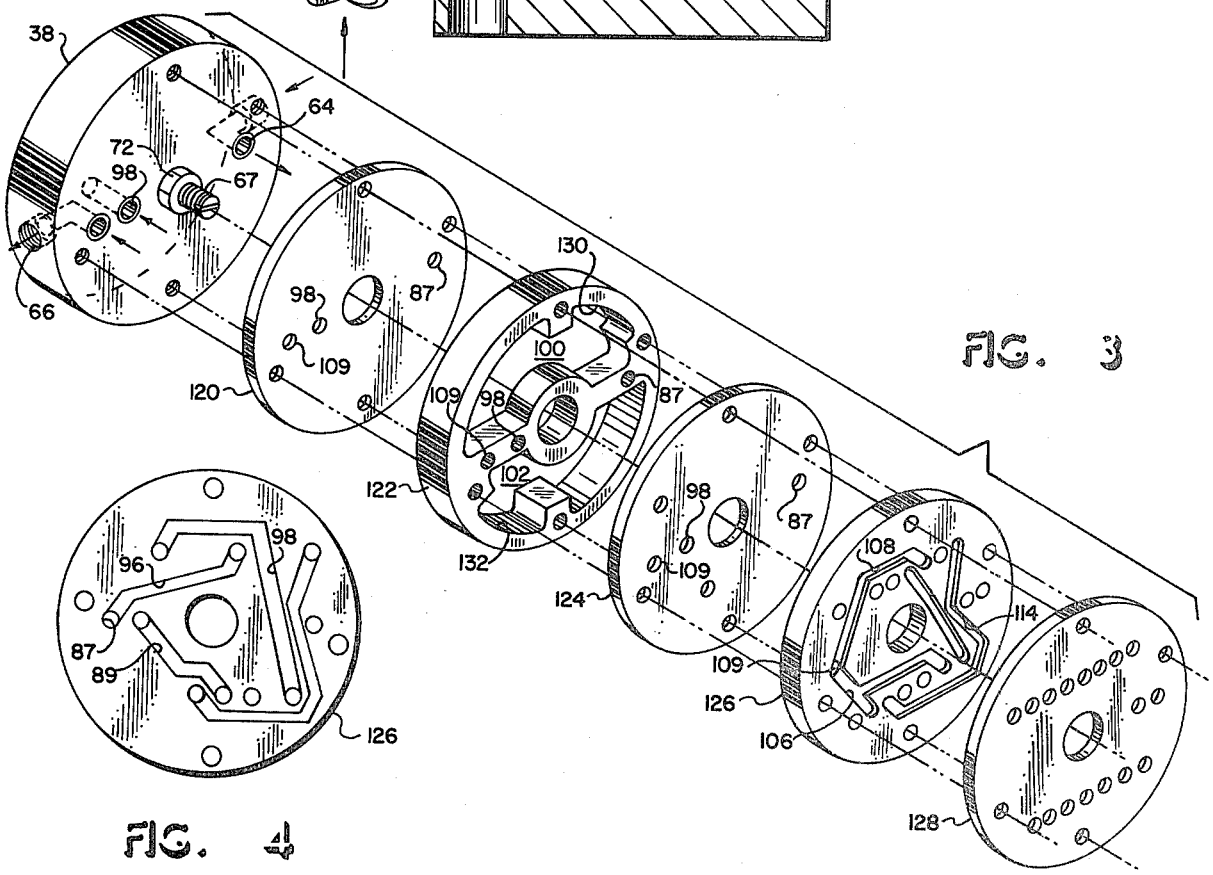
FIG. 3
FIG. 4

FLUID OPERATED DIAPHRAGM PUMP WITH FLUID TIMING CONTROL AND CONTROL CIRCUIT MANIFOLD MOUNTED ON PUMP BODY

CROSS REFERENCE TO RELATED APPLICATION

This application is a continuation-in-part of my prior co-pending U.S. patent application Ser. No. 16,185 filed: Feb. 28, 1979 now abandoned.

BACKGROUND OF THE INVENTION

1. Field of the Invention

This invention pertains to a pressure fluid operated metering pump having an improved pneumatic control system mounted directly on the pump body and incorporated partially in an improved pneumatic circuit manifold assembly.

2. Background Art

The above referenced patent application discloses a pressure fluid operated metering pump having a power piston comprising a rolling diaphragm mechanically connected to a pump piston also of the flexible diaphragm type. The pump control mechanism disclosed in the above referenced patent application includes a control circuit which utilizes a fluid operated spool valve for delivering fluid pressure pulses to the working piston of the pump and for exhausting the working piston expansion chamber. The fluid operated valve is controlled by an electrically energized valve operator which in turn is controlled by an electronic pulsing circuit.

In many applications of metering pumps the pump is situated in a hazardous environment created by the pumped fluid being a volatile substance or the application of the pump being in the vicinity of explosive gases or liquids. Moreover, in many applications of metering pumps and the like it is desirable and advantageous to utilize the working fluid to operate the pump control components to simplify the pump installation requirements. It is particularly advantageous to utilize the working fluid as a controlling medium if the fluid is compressed air or other compressed gases.

There are also advantages in certain applications of metering pumps to utilize a working fluid which may be a toxic or explosive gas and, accordingly, it is important to be able to eliminate any electrical components in the vicinity of the pump and be able to provide for conducting the spent working fluid into an exhaust conduit or chamber to avoid venting the working fluid to atmosphere.

Many applications of metering pumps require a very wide range of discharge flow rates. Electrical circuitry required to meet the desired range of flow rates for metering pumps becomes unduly complicated and expensive and, accordingly, pressure fluid controls are advantageously used for applications requiring a wide range of flow rates. In this regard also it is important in many pump applications to have a control system which will operate with a working fluid and a control fluid wherein the fluid pressures may vary considerably.

It is, of course, desirable that metering pumps be as compact and inexpensive to manufacture as practical. In this regard it is noted that many prior art pumps do not have a compact control system which is adapted to be mounted directly on the pump itself and is entirely self contained to minimize fluid conduit interconnections and the like which contribute to fluid leakage and the problems attendent thereto.

SUMMARY OF THE INVENTION

The present invention provides an improved fluid operated metering pump having a pressure fluid control system which utilizes the working pressure fluid as a control medium for operating suitable control valves to control the delivery and exhaust of working fluid with respect to the power piston chamber of the pump.

In accordance with one aspect of the present invention a pneumatic operated metering pump is provided having a power piston comprising a rolling diaphragm mechanically interconnected to a pump piston also characterized as a resilient diaphragm member and wherein the power piston is actuated by a pneumatic control circuit including a pair of pilot operated control valves. The control circuit and the associated control valves are mounted on a compact circuit manifold assembly which is removably fastened directly to an end wall of the power chamber of the pump. Substantially all of the fluid conduits of the control circuit and the power fluid circuit are contained within a multilayer fluid manifold assembly of a superior design and which is removably mounted directly to an end wall of the power piston chamber of the pump. The control circuit is arranged to utilize the pump working fluid as the control circuit fluid and all of the fluid is routed into and out of the pump body through respective inlet and exhaust passages. Accordingly, the working and control fluid may be compressed air or other types of gases which cannot be vented to atmosphere In accordance with yet another aspect of the present invention a fluid operated control circuit is provided for a fluid operated metering pump which has an improved operating range to provide for operating the pump over a wide range of flow rates. The combination of a pair of four way pressure fluid pilot operated valves together with an adjustable flow control or metering valve as well as a pair of pressure fluid timing chambers provides for a compact and superior control circuit which is operable to provide for a wide range of pump stroke frequencies and is easily adjustable to vary the pump operating range.

In accordance with still another aspect of the present invention a pressure fluid control circuit is provided in a circuit manifold assembly of superior design and construction which is compact, substantially self contained and includes substantially all of the flow conduits and passages interconnecting the control valves with each other and with the pump power piston chamber. The improved control circuit manifold assembly is adaptable to high volume production at relatively low cost, is less susceptible to fluid leakage, is reliable in operation, and not particularly susceptible to errors in assembly which would result in incorrect circuit connections. The fluid control circuit manifold assembly is preferably made of molded plastic parts which are economical to manufacture and resistant to corrosion from the working fluid as well as other fluids which might be present in the working environment of the pump.

The present invention still further provides for an improved control circuit for a fluid metering pump wherein fluid timing chambers are provided which are adapted to be used with a liquid control fluid.

The present invention still further provides an improved stroke adjustment mechanism in conjunction with a fluid operated metering pump of the type having a fluid actuated power piston mechanically connected to a fluid piston.

Those skilled in the art will appreciate from reading the following detailed description in conjunction with the drawings that a superior metering pump and associated control circuit is provided by the present invention.

BRIEF DESCRIPTION OF THE DRAWINGS

FIG. 1 is a longitudinal side elevation, in section, of a fluid operated diaphragm type metering pump embodying the improvements of the present invention;

FIG. 4 is a plan view of the opposite side of one of the manifold components illustrated in FIG. 3; and FIG. 5 is an exploded perspective view of a portion of the control circuit manifold assembly adapted for use of a liquid control fluid.

DESCRIPTION OF THE PREFERRED EMBODIMENTS

Figure 2:
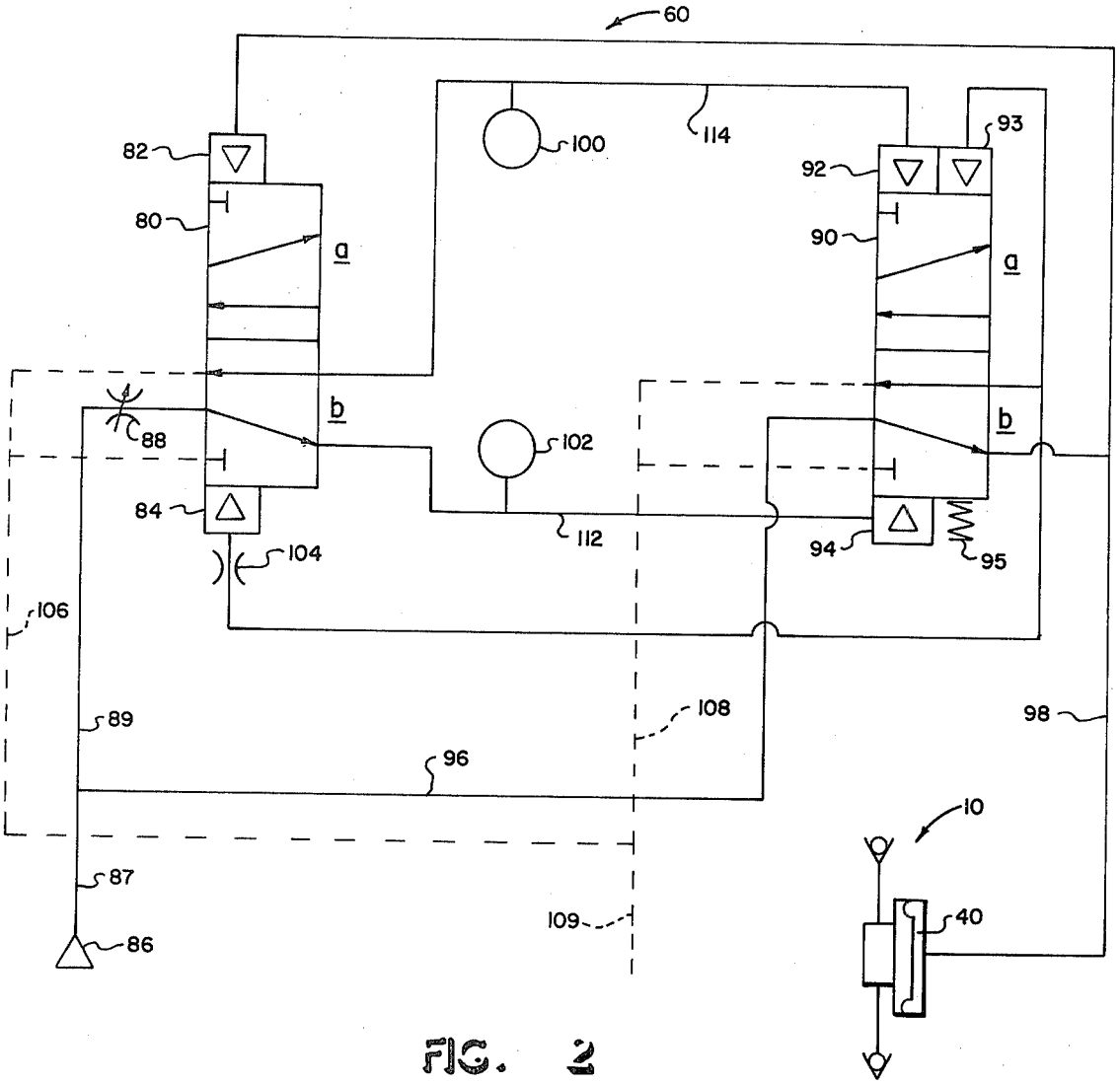
FIG. 2 is a schematic of the control circuit of the improved metering pump illustrated in FIG. 1.

Referring to FIG. 1, there is illustrated in longitudinal center section an improved fluid metering pump generally designated by the numeral 10. The pump 10 comprises a cylindrical body member 12 having opposed cylindrical cavities 14 and 16 connected by a bore 18 of reduced diameter. A circular piston member 20 is disposed in the cavity 16 and is characterized as a resilient diaphragm made of a suitable elastomeric material. The diaphragm 20 is suitably secured in sealing engagement between the body 12 and a cylindrical head member 22. The head member 22 includes an interior cavity 24 delimited by the diaphragm 20 and in communication with respective inlet and discharge passages 26 and 28. The inlet passage 26 is adapted to be connected to a source of pumped fluid by way of an inlet valve 30. The passage 28 is adapted to be in communication with a pumped fluid discharge line by way of a discharge valve 32.

The diaphragm 20 is connected to a power piston comprising a support member 34 disposed in the cavity 14 and engaged with a resilient rolling diaphragm 36. The diaphragm 36 is suitably clamped between an end face of the body 12 and an intermediate body member 38. An expansible chamber 40 is formed between the diaphragm 36 and a recess formed in the end surface of the body member 38 facing the power piston. The piston 34 is substantially rigidly interconnected with a hub portion 21 of the diaphragm 20 by means of a threaded fastener 44 and is held in spaced apart relation with respect to the hub portion by a tubular member 42. The power piston and pumped fluid diaphragm assembly are biased into the position illustrated in FIG. 1 by suitable coil springs 48 interposed between the end wall 50 of the cavity 14 and the surface 52 of the piston 34.

The pump 10 further includes a cylindrical annular body member 54 having a reduced diameter axially extending portion 56. A cover 58 is threadably connected to the body member 54 and forms an enclosure for an improved control system for operating the pump 10 and generally designated by the numeral 60. The pump 10 also includes a suitable frame 62 for supporting the pump in the operative position.

Figure 3:
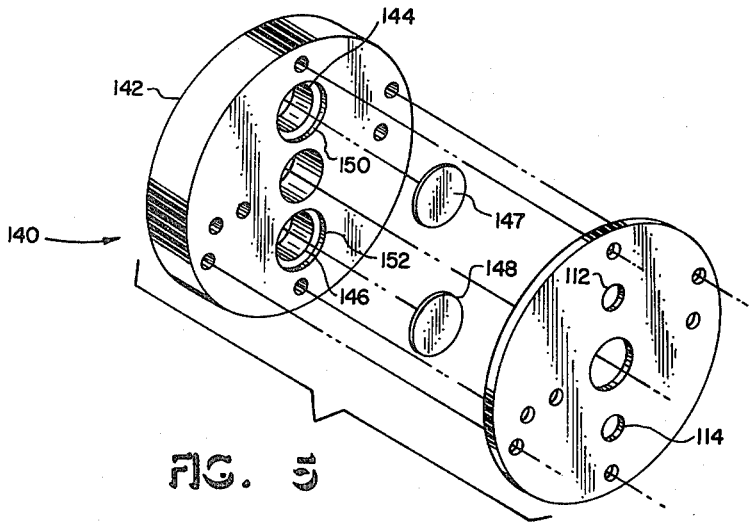
FIG. 3 is an exploded perspective view of the components comprising the pneumatic control circuit manifold assembly for the pump shown in FIG. 1.

A particularly advantageous aspect of the pump 10 pertains to an arrangement of the control system 60 wherein the working fluid for powering and controlling the pump is conducted to the control system by way of an inlet passage 64 formed in the intermediate body member 38, as shown in FIG. 3. Moreover, working fluid vented from the chamber 40 and the control system 60 is conducted from the pump by way of a passage 66 also provided in the intermediate body member 38. The head 22 and the body members 12, 38 and 54 are held in assembly by suitable threaded fasteners, not shown, in a manner similar to the arrangement of the pump disclosed in my prior co-pending application Ser. No. 16,185.

The pump 10 is provided with an improved means for adjusting the length of stroke of the piston 34 comprising a disk shaped abutment or stop member 65 having a threaded shank 67 which is threadedly engaged with a central tapped hole in the body member 38 and extends axially into a bore 68 provided in a manifold assembly 70. The manifold assembly 70 comprises a part of the control system 60 to be explained in further detail herein. The stop member 65 is retained in a predetermined axially extending position by a lock nut 72. Accordingly, the stop member 66 may be adjustably positioned with respect to the power piston 34 to limit the movement of the piston to the right, viewing FIG. 1 to limit the stroke of the piston assembly and accordingly, the volumetric displacement per stroke of the pump 10. A transverse slot 69 is formed in the shank 67 and is adapted to be engaged by a suitable tool such as a screw driver for adjusting the position of the stop member 65.

The pump 10 is adapted to be operated with the improved pressure fluid control system 60 which is illustrated in schematic form in FIG. 2. The control system 60 includes the manifold assembly 70 which includes substantially all of the passages interconnecting the control components of the control system and is of a superior design which will be explained in further detail herein. Referring to FIG. 2, the control system 60 includes a two position pilot actuated valve 80 having respective pressure fluid actuators 82 and 84. The valve 80 is adapted to be in communication with a source of pressure fluid such as compressed air designated by the numeral 86 by way of a conduit 87. The control system 60 further includes an adjustable flow control valve indicated by the numeral 88 interposed in a conduit portion 89 between the valve 80 and the source of pressure fluid 86.

The control system 60 also includes a pressure fluid operated two position valve 90 having pressure fluid pilot actuators 92, 93 and 94. The valve 90 is adapted to be in communication with the source of pressure fluid 86 by way of branch conduit 96. The valve 90 is also adapted to be in communication with the expansible chamber 40 by way of conduit 98 represented schematically in FIG. 3. The control system 60 further includes a pair of pressure fluid timing chambers designated by the numerals 100 and 102, and a flow restricting orifice for the pilot actuator 84 which is designated by the numeral 104 in FIG. 2.

The control system 60 includes an exhaust conduit 106 connected to the valve 80 and an exhaust conduit 108 connected to the valve 90. The exhaust conduits 106 and 108 are adapted to be in communication by way of passage means 109 with the exhaust passage 66 in the intermediate body member 38. Accordingly, as will be appreciated from reading the further description herein all of the fluid utilized to operate the power piston 34 as well as shifting of the control valves 80 and 90 may be vented through a single passage within the pump 10, which passage may be in communication with the exterior of the pump through venting of the pressure fluid to atmosphere or by conducting exhaust fluid through a suitable conduit to a point remote from the pump installation.

For convenience in describing the operation of the control system 60 the valves 80 and 90 are designated as being operable to be in position a or position b, respectively. Valve 80 is pilot actuated to either position a or position b and valve 90 is normally biased into position b by a spring actuator 95 but is operable to be pilot actuated to its b position by actuator 94 and to be actuated to its a position by pilot actuators 92 or 93. The pilot actuator 94 and the timing chamber 102 are in communication with valve 80 by way of a passage 112.

The timing chamber 100 and the pilot actuator 92 are in communication with valve 80 by way of passage 114 and the pilot actuators 82, 84 and 93 are controlled by the valve 90 in accordance with the schematic diagram of FIG. 2.

The control system 60 is operable to cause the pump 10 to complete a suction and discharge stroke at a variable rate depending on the pressure of the fluid applied to operate the valve 90 by way of the valve 80 and the flow control valve 88. With the control circuit illustrated in FIG. 2 in the condition shown and with pressure fluid supplied from the source 86 the valve 90 is in position b which supplies pressure fluid to the chamber 40. With valve 90 in position b the pilot actuators 84 and 93 are vented to the exhaust conduit 108 and the pilot actuator 82 is pressurized to shift the valve 80 to its position a. When valve 80 shifts to its position a the pilot actuator 94 is vented to the exhaust conduit 106 and the pilot actuator 92 is pressurized by way of passage 114. However, the setting of the flow control valve 88 and the provision of the timing chamber 100 will delay the actuation of valve 90 to its position a overcoming the bias of the spring actuator 95. When valve 90 shifts to position a pressure fluid is supplied to pilot actuator 93 and pilot actuator 84. In position a of valve 90 the pump chamber 40 is vented to the exhaust conduit 108. When valve 90 has shifted to position a it is interlocked in that position by the actuator 93. Valve 80 will shift back to its position b after a slight time delay due to the orifice 104 of the pilot actuator 84. As soon as valve 80 returns to its position b pilot actuator 94 will commence to be pressurized through passage 112 but the shifting of valve 90 back to position b will be delayed in accordance with the setting of flow control valve 88 and due to the timing chamber 102. As soon as sufficient pressure build up occurs in pilot actuator 94 valve 90 will shift to the position to provide pressure fluid to chamber 40 to cause the pump 10 to discharge the pumped fluid in the pump chamber 24. With the valve 90 in position b the sequence described above will commence again. The discharge pump stroke will be allowed to proceed to completion due in part to the timing chamber 100 which together with valve 88 delays the shifting of valve 90 to position a to vent the pump chamber 40.

Moreover, the timing chamber 102 alone or in combination with the valve 88 provides for a delay in shifting the valve 90 to its position b whereby the pump piston assembly is allowed to undergo a suction stroke to draw pumped fluid into the chamber 24 through the inlet valve 30. As will be appreciated by those skilled in the art the timing chambers 100 and 102 together with the flow control valve 88 are operable to control the pump stroke frequency in both the suction and discharge portions of the stroke cycle. Accordingly, by adjustment of the flow control valve 88 for a particular supply pressure the pump may be operated through a substantial frequency range of suction and discharge strokes to control the flow rate of the pump. It will be further appreciated by those skilled in the art that the control system 60, illustrated schematically in FIG. 2, provides a superior pressure fluid control circuit for use in a fluid operated metering pump or the like.

The present invention further includes the improved manifold assembly 70, in which all of the passage and conduit means interconnecting the valves 80 and 90 are located, and on which the valves are mounted to form a compact assembly which is removably mounted on the pump body member 38. Referring now to FIG. 3 of the drawings the manifold assembly 70 is illustrated in an exploded perspective view to show the separate parts and their arrangement with respect to each other. The manifold assembly 70 includes a circular inner cover plate member 120 which, together with the other members of the manifold assembly may be suitably made of metal or plastic. The manifold assembly of the present invention further includes intermediate plate members 122, 124 and 126 and an outer cover plate member 128. The plate member 122 together with members 120 and 124 form the timing chambers 100 and 102 which are characterized by respective cavities 130 and 132 formed in the plate member 122. The plate members 120 and 124 are adapted to be sealably engaged with the plate member 122 to form end walls for the cavities 130 and 132 respectively. In the pump control system 60 of the present invention it is desirable to have relatively large cavities forming the timing chambers 100 and 102 which must be larger in volume than the passages 114 and 112, respectively. Moreover, commercially available volume chambers would make the manifold assembly unduly bulky. However, by providing the arrangement of the manifold assembly 70, as illustrated in FIG. 3, the timing chambers 100 and 102 are advantageously incorporated directly into a relatively compact structure.

Referring also to FIG. 4, the manifold conduit plate 126 includes a plurality of elongated channels formed in the opposite face thereof which interconnect suitable openings in the plate 126 and the outer cover plate 128 to comprise all of the passages and conduit means interconnecting the valves 80 and 90. The valves 80 and 90 are adapted to mount on the outer wall surface of the plate 128, as illustrated in FIG. 1, with the respective valve ports aligned with the proper openings in the plate member 128. The valves 80 and 90 are suitably retained on the plate member 128 by removable retainer plates 131 and 133.

The manifold assembly 70 is easily fabricated by, for example, manufacturing all of the plate members out of molded plastic, assembling the plate members in stacked relationship and sealably fastening the plate members to each other permanently by a suitable adhesive applied to the respective surfaces of the plate members which are to be in engagement with each other. As shown in FIG. 1, the entire control system 60 of the present invention is removably mounted on the intermediate body member 38 of the pump 10 by threaded fasteners 134. Accordingly, a compact and economically fabricated manifold assembly is provided in accordance with the present invention which includes substantially all of the fluid passages and conduits of the control system as well as volume chambers used to provide timing functions in the control system.

The control system 60 is particularly adapted to operate on compressed air or other pressure gases. However, the control circuit shown in FIG. 2 of the drawings may be easily adapted to use a pressure liquid as a control and power fluid for the pump 10. If the control system 60 is adapted for use in connection with a pressure liquid as the control fluid it is necessary that the timing chambers 100 and 102 be suitably modified to provide the timing function required for the desired flow range of the pump 10. Referring to FIG. 5 a modification of the manifold assembly 70 is illustrated, in part, and generally designated by the numeral 140. The manifold assembly 140 is similar in some respects to the manifold assembly 70 but includes a modified plate member 142 including cylindrical cavities 144 and 146 in place of the cavities 130 and 132, respectively. The manifold assembly 140 also includes resilient distendable diaphragms 147 and 148 which are adapted to fit over the cavities 142 and 144 are disposed in recesses 150 and 152. The diaphragms 146 and 148 may be secured in their respective recesses by the clamping action of the intermediate plate 124. Accordingly, when pressure liquid is admitted to the passages 112 or 114 the diaphragms 147 and 148 may be respectively distended into their respective cavities against the pressure forces of a compressible fluid to perform the timing function by delaying the increase in fluid pressure sufficient to cause the actuators of valve 90 to shift the valve from one position to another. The timing characteristics of the modified timing chambers illustrated in FIG. 5 may be further altered by providing for changing the pressure on the opposite side of the diaphragms 147 and 148 by providing suitable conduits leading to the cavities and associated shut off valves, respectively, whereby the fluid pressure in the cavities may be adjusted to alter the timing characteristics of the control circuit.

It will be appreciated from the foregoing that an improved pressure fluid controlled pump is provided by the present invention. While the invention has been particularly shown and described with reference to preferred embodiments it will be understood by those skilled in the art that changes in form and detail may be made without departing from the scope and spirit of the invention.

What I claim is:

1. A fluid operated pump including power piston means and pumping piston means interconnected one with the other, said power piston means being disposed in an expansible chamber and operable in response to pressure fluid being admitted to said chamber to drive said pumping piston means through a pump discharge stroke, means for driving said piston means through a pump suction stroke when said chamber is vented, and a control system for causing said pump to operate through a pumping cycle including a suction stroke and a discharge stroke, said control system comprising:

a first pressure actuated two position valve including first and second fluid actuators for moving said first valve to a first position for conducting pressure fluid from a source to said chamber and a second position for venting said chamber, respectively;

a second pressure fluid actuated two position valve including pressure fluid actuators for moving said second valve between a first position for conducting pressure fluid from said source to actuate said first valve to move to said first position and a second position for conducting pressure fluid from said source to actuate said first valve to move to said second position;

pressure fluid timing means operable to delay the movement of said first valve to said first position and said second position in response to movement of said second valve so as to control the frequency of said pumping cycle, said timing means including a flow control valve disposed between said source and said second valve, a first pressure fluid timing chamber interposed in a conduit interconnecting said second valve and said first actuator of said first valve and a second pressure fluid timing chamber interposed in a conduit interconnecting said second valve and said second actuator of said first valve, and a fluid manifold assembly including a plurality of platelike members assembled in stacked side by side relationship, said manifold assembly including conduit means interconnecting said first and second valves and a pair of cavities formed in at least one of said members and comprising said first and second timing chambers.

2. In a pressure fluid operated metering pump:

a body including first and second cavities;

a flexible diaphragm power piston disposed in said first cavity and connected to a flexible diaphragm pump piston disposed in said second cavity, and power piston forming with said first cavity a working fluid chamber, said chamber being delimited by an end wall of said body;

a piston stroke limiting abutment disposed in said working fluid chamber for engagement with said power piston, said abutment being mounted on said end wall of said body and including a shank portion projecting through said end wall for positioning said abutment for engaging said power piston to limit the stroke thereof;

a pressure fluid control system for operating said pump and including a pressure fluid manifold assembly mounted on said body against said end wall of said body, control valve means mounted on an outer face of said manifold assembly, passage means in said end wall in communication with cooperating passage means in said manifold assembly and said control valve means, and an opening through said manifold assembly, said shank portion being disposed in said opening and being accessible from the exterior of said pump for adjustably positioning said abutment.

3. The invention set forth in claim 2 wherein:

said manifold assembly includes a plurality of separate plate members arranged in stacked face to face relationship and defining said passage means for conducting pressure fluid to and from said working fluid chamber.

4. The invention set forth in claim 2 including:

a pressure fluid inlet conduit in said body and adapted to be in communication with a source of pressure fluid and first passage means in said manifold assembly, and a pressure fluid exhaust conduit in said body for conducting all exhaust fluid from said working chamber and said control valve means through said manifold assembly to the exterior of said pump.

5. The invention set forth in claim 2 wherein:

said shank portion is threadedly engaged with said end wall.

6. The invention set forth in claim 5 wherein:

said shank portion includes tool engaging means on the distal end thereof.

7. The invention set forth in claim 5 together with:

a lock nut threadedly engaged with said shank portion and an exterior surface of said end wall of said body for locking said abutment in a predetermined position.

8. A fluid operated pump including power piston means and pumping piston means interconnected one with the other, said power piston means being disposed in an expansible chamber and operable in response to pressure fluid being admitted to said chamber to drive said pumping piston means through a pump discharge stroke, means for driving said piston means through a pump suction stroke when said chamber is vented, and a control system for causing said pump to operate through a pumping cycle including a suction stroke and a discharge stroke, said control system comprising:

a first pressure fluid actuated two position valve including first and second fluid actuators for moving said first valve to a first position for conducting pressure fluid from a source to said chamber and a section position for venting said chamber, respectively;

a second pressure fluid actuated two position valve including pressure fluid actuators for moving said second valve between a first position for conducting pressure fluid from said source to actuate said first valve to move to said first position and a second position for conducting pressure fluid from said source to actuate said first valve to move to said second position;

conduit means interconnecting said second valve and said actuators of said first valve for moving said first valve between its first and second positions in response to movement of said second valve; and, pressure fluid timing means including timing chamber means interposed in said conduit means and means for controlling the flow of fluid to said timing chamber means to selectively delay the movement of said first valve to said first position and said second position in response to movement of said second valve so as to control the frequency of said pumping cycle.

9. The invention set forth in claim 8 together with:

further actuator means for biasing said first valve in said first position.

10. The invention set forth in claim 8 wherein:

said means for controlling the flow of fluid to said timing chamber means includes a flow control valve disposed between said source and said second valve.

11. The invention set forth in claim 10 wherein:

said flow control valve includes means for manual adjustment of the fluid flow rate through said flow control valve.

12. The invention set forth in claim 10 wherein:

said timing means includes a first pressure fluid timing chamber interposed in a conduit interconnecting said second valve and said first actuator of said first valve.

13. The invention set forth in claim 12 wherein:

said timing means includes a second pressure fluid timing chamber interposed in a conduit interconnecting said second valve and said second actuator of said first valve.

14. A fluid operated pump including a body, a fluid operated power piston disposed in an expansible chamber formed in said body, and a control system for conducting working pressure fluid to and from said expansible chamber, said control system comprising:

a manifold assembly including a plurality of plates sealingly secured to each other in stacked relationship, said manifold assembly including an inner cover plate and an outer cover plate, said inner cover plate being adapted to be secured in engagement with a mounting face on said pump body, said outer cover plate being adapted to have control valve means mounted thereon, said manifold assembly including an intermediate plate member having at least a first cavity formed therein comprising a pressure fluid timing chamber for said control system.

15. The invention set forth in claim 14 wherein:

said plates are circular and said manifold assembly includes a longitudinal central bore forming an opening for accommodating a pump stroke adjustment mechanism disposed on said body member.

16. The invention set forth in claim 14 wherein:

said manifold assembly includes an intermediate cover plate, and at least one conduit plate, said conduit plate including a plurality of channels formed in one face, said one face being adapted to be in fluid sealing engagement with a cooperating face on one of said outer cover plate and said intermediate cover plate.

17. The invention set forth in claim 16 wherein:

said conduit plate includes channels formed in opposite faces of said conduit plate and adapted to form conduits interconnecting said control valve means.

18. The invention set forth in claim 16 wherein:

said intermediate plate member includes a second cavity formed therein, and said intermediate plate member is cooperable with at least one other plate member to form separate timing chambers in said manifold assembly said timing chambers being substantially larger in volume than the volume of any one of said channels formed in said conduit plate and in communication with said timing chambers, respectively.

19. The invention set forth in claim 18 wherein:

said timing chambers include resilient diaphragm means dividing said timing chambers into a liquid cavity and pressure gas cavity.

* * * * *